US008596249B2

(12) United States Patent
Zhang et al.

(10) Patent No.: US 8,596,249 B2
(45) Date of Patent: Dec. 3, 2013

(54) FUEL DELIVERY MODULE REINFORCED FUEL TANK

(75) Inventors: Yi Zhang, Ann Arbor, MI (US); Dat Le, Dearborn, MI (US); Steven Antone Thiel, Saline, MI (US); Brent Darrell Brawn, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 802 days.

(21) Appl. No.: 12/816,151

(22) Filed: Jun. 15, 2010

(65) Prior Publication Data

US 2011/0139128 A1 Jun. 16, 2011

(51) Int. Cl.
*F02M 37/04* (2006.01)

(52) U.S. Cl.
USPC ..... 123/509

(58) Field of Classification Search
USPC ..... 123/509, 478, 514–516, 506, 497
See application file for complete search history.

(56) References Cited

U.S. PATENT DOCUMENTS

| | | | | |
|---|---|---|---|---|
| 2,407,455 | A | 9/1946 | Shakesby et al. | |
| 4,353,847 | A * | 10/1982 | Sato et al. | 261/36.2 |
| 4,526,286 | A | 7/1985 | Jüng et al. | |
| 4,750,518 | A * | 6/1988 | Griffin et al. | 137/574 |
| 5,961,764 | A | 10/1999 | Sydow et al. | |
| 6,135,306 | A | 10/2000 | Clayton et al. | |
| 6,149,399 | A * | 11/2000 | Bowser et al. | 123/509 |
| 6,338,420 | B1 | 1/2002 | Pachciarz et al. | |
| 6,843,384 | B2 | 1/2005 | Schmidt et al. | |
| 7,159,578 | B2 | 1/2007 | Horvath et al. | |
| 7,201,152 | B2 * | 4/2007 | Leymarie et al. | 123/509 |
| 7,341,046 | B2 * | 3/2008 | Leymarie et al. | 123/509 |
| 7,475,678 | B2 * | 1/2009 | Douyama et al. | 123/509 |
| 7,485,219 | B2 * | 2/2009 | Urbahn et al. | 210/167.01 |
| 7,507,131 | B2 * | 3/2009 | Schaefer, Jr. | 440/88 F |
| 7,516,868 | B2 * | 4/2009 | Fukushima et al. | 220/562 |
| 7,523,745 | B2 * | 4/2009 | Troxler et al. | 123/509 |
| 2002/0066737 | A1 | 6/2002 | Stack et al. | |

* cited by examiner

*Primary Examiner* — Hieu T Vo
(74) *Attorney, Agent, or Firm* — Julia Voutyras; Alleman Hall McCoy Russell & Tuttle LLP

(57) ABSTRACT

Systems and methods are provided for a structurally supportive fuel delivery module coupled to an upper and lower wall of a fuel tank.

19 Claims, 8 Drawing Sheets

FUEL DELIVERY MODULE REINFORCED FUEL TANK

FIELD

The present invention relates to reinforced fuel tanks.

BACKGROUND AND SUMMARY

Deflections may occur in fuel tanks due to pressure and vacuum changes, e.g., due to differences between atmospheric pressure around the tank body and the pressure of a gaseous mixture of air and fuel vapor in the fuel tank body. For example, when gas pressure in the tank body exceeds atmospheric pressure, the top of the tank body may expand away from the bottom of the tank body. When atmospheric pressure exceeds the gas pressure in the tank body, the top of the tank body may collapse toward the bottom of the tank body.

Pressure and vacuum changes experienced by a fuel tank may increase when sealed evaporation control (EVAP) systems are employed to reduce evaporative emissions and fuel leakage, e.g., in hybrid electric vehicles. For example, fuel tanks may be partially reinforced by increasing thickness of fuel tank walls and/or including structural elements within the fuel tank body in addition to various non supportive components such as sensors and fuel delivery components within the fuel tank body.

In one particular approach, a non-supportive fuel delivery module (an integrated system that combines various fuel system components in a single unit positioned in the fuel tank body) may be included in a fuel tank body. Such fuel delivery modules may not provide structural reinforcement to fuel tanks For example, a non-supportive fuel delivery module may include a top flange and bottom cup which are slidably connected, e.g. through sliding steel rods and coil springs, such as described in U.S. Pat. No. 7,159,578.

The inventors herein have recognized issues with such approaches. For example, structural elements included inside a fuel tank may reduce fuel storage volume and available space for sensors and/or fuel delivery components, e.g., a fuel delivery module. Additionally, increasing fuel tank wall thickness may lead to higher material costs and greater fuel tank weight, which may lead to lower fuel efficiency in a vehicle, for example.

To at least partially address these issues, a system is provided comprising: a fuel tank including an upper wall and a lower wall; and a support member, where the support member includes a plurality of fuel system components and the support member is coupled to the upper and lower walls of the fuel tank. In some examples, the support member may be a structurally supportive fuel delivery module.

In this way a fuel tank may be reinforced without the addition of structural elements in the body of the fuel tank which impinge on fuel storage volume and/or lead to higher material costs. Further, fuel tank deformation may be reduced when subjected to pressure and vacuum changes. Additionally, fuel tank wall thickness may be reduced leading to lower material cost and increased fuel efficiency.

It should be understood that the background and summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
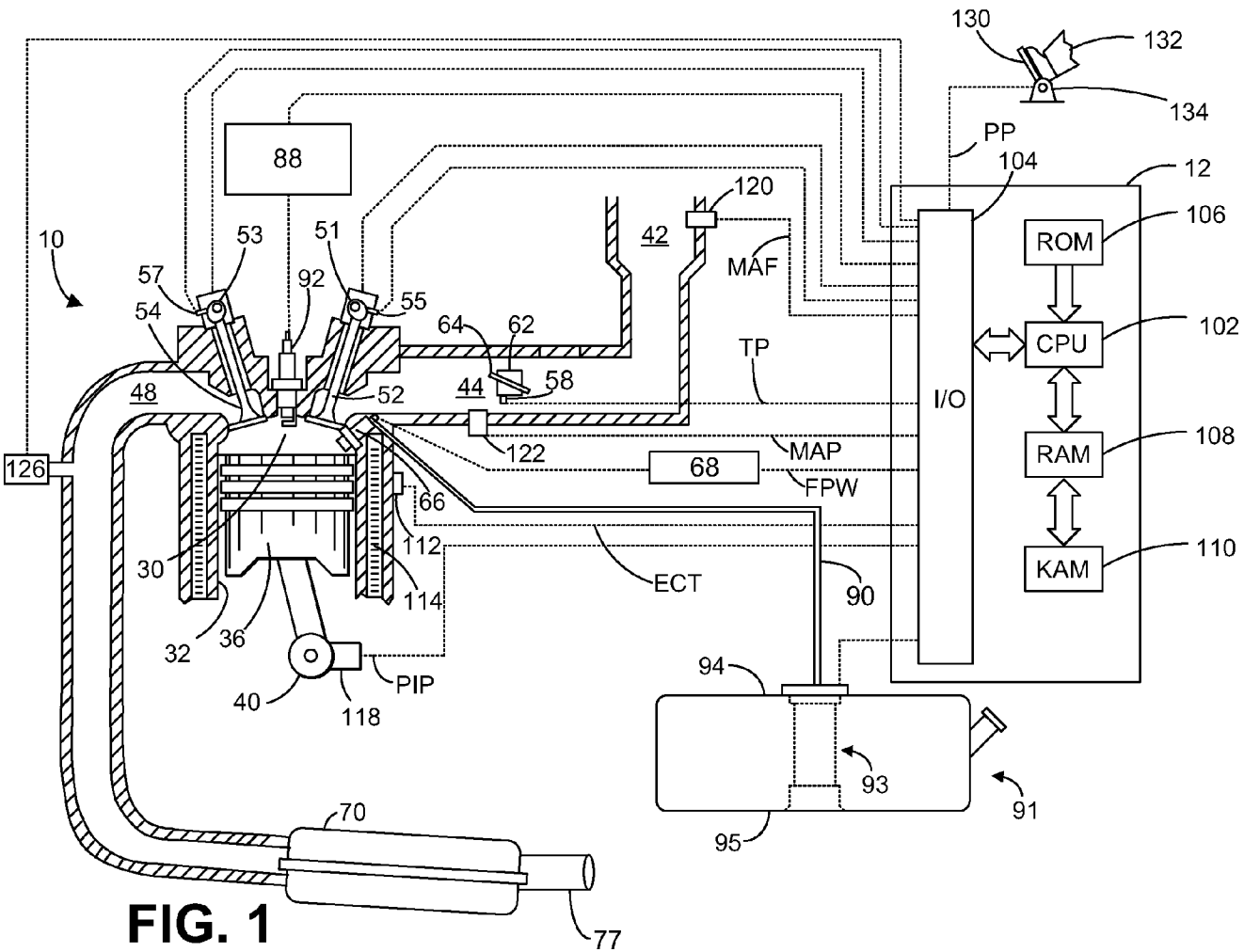
FIG. 1 shows a schematic view of an engine with a fuel tank.

The following description relates to a fuel tank reinforced with a supportive fuel delivery module (an integrated system that combines a variety of fuel system components into a single module). Such a fuel tank may be used to store fuel for delivery to an engine, such as shown in FIG. 1, e.g., to propel a vehicle.

Figure 2:
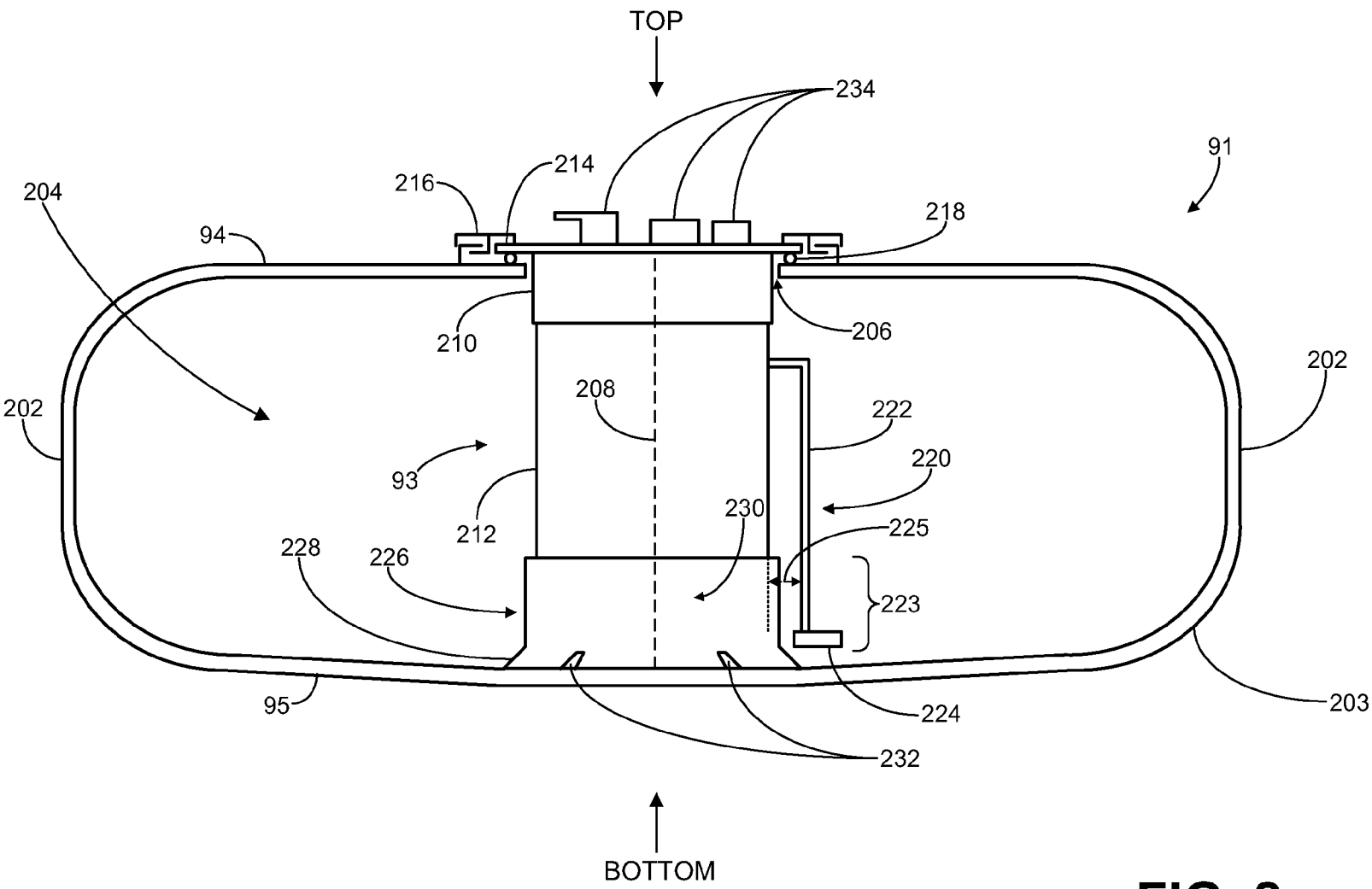
FIG. 2 shows an example fuel tank including a supportive fuel delivery module.
Figure 4:
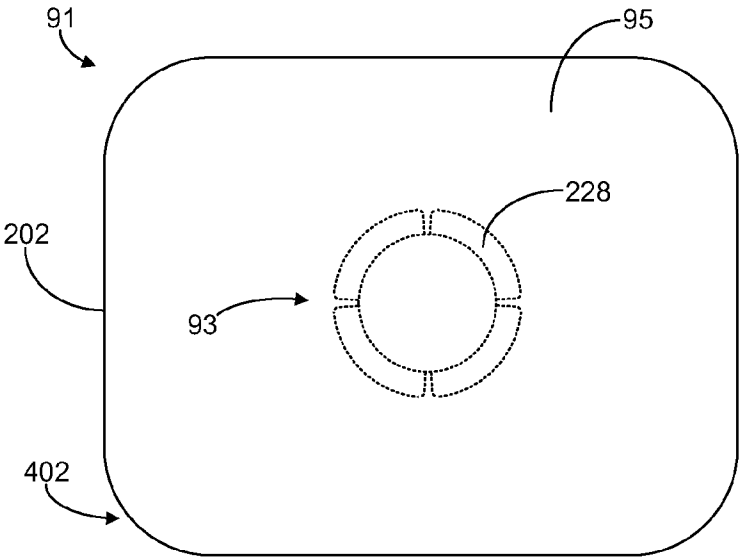
FIG. 4 shows a bottom view of an example fuel tank including a supportive fuel delivery module.
Figure 3:
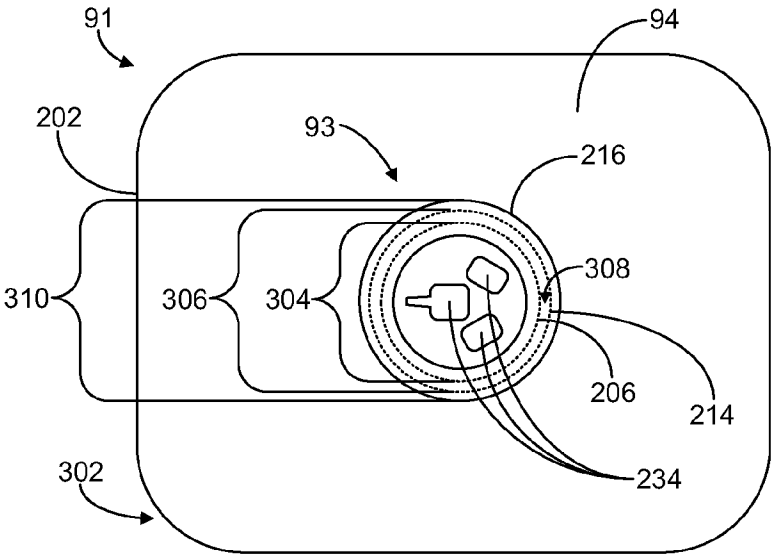
FIG. 3 shows a top view of an example fuel tank including a supportive fuel delivery module.

FIGS. 2-4 show an example fuel tank including a structurally supportive fuel delivery module (FDM) coupled to outer walls of the fuel tank so as to reduce deflections in the outer walls, e.g., due to pressure and vacuum changes which may occur in the fuel tank.

Figure 6:
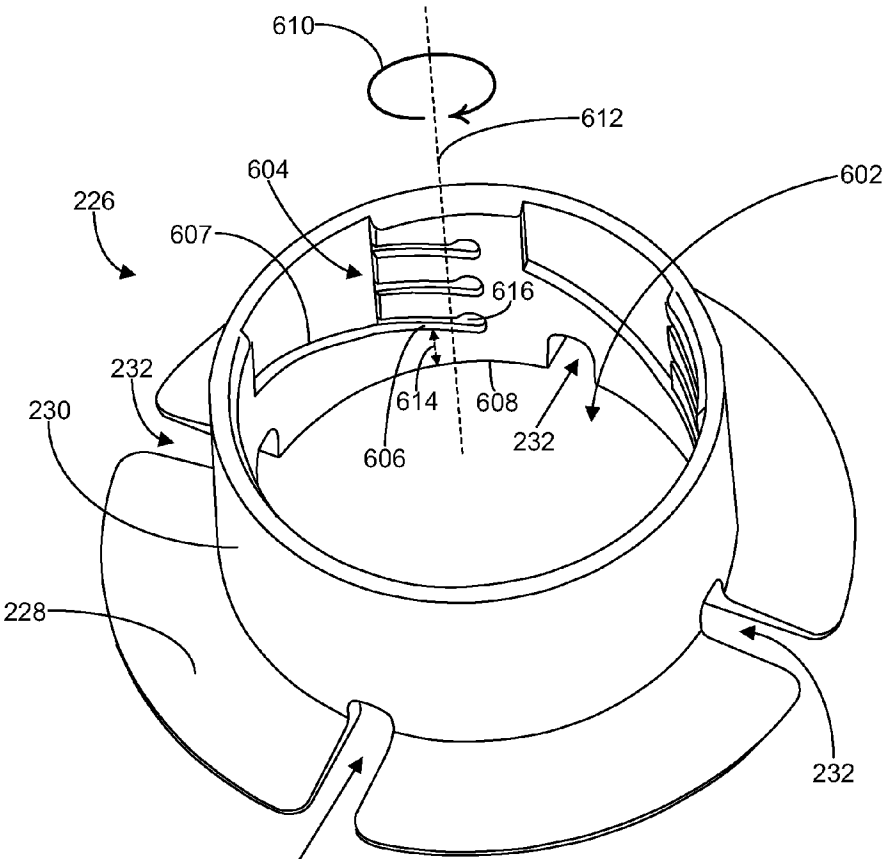
FIG. 6 shows an example supportive fuel delivery module retainer with threaded features.
Figure 5:
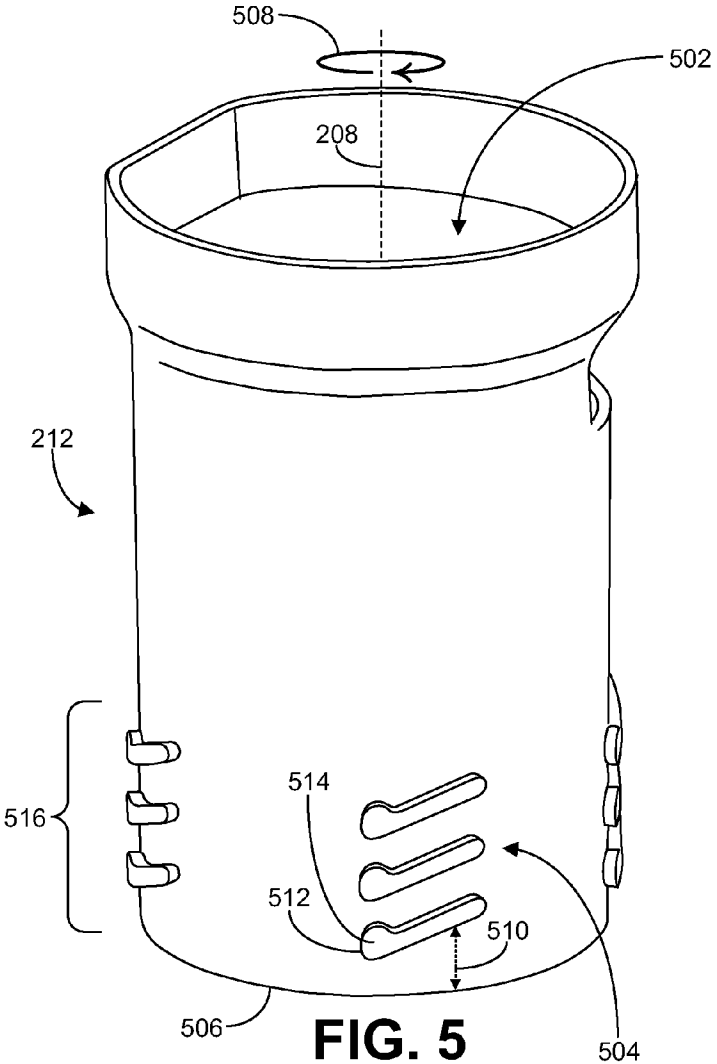
FIG. 5 shows an example supportive fuel delivery module body with threaded features.

A structurally supportive FDM, an example of which is shown in FIGS. 9-12, may include various features to assist in coupling of the FDM to the outer walls of a fuel tank. For example, a retainer coupled to a lower wall of the fuel tank may be configured to lockably receive a base portion of the FDM, e.g., as shown in FIGS. 5 and 6.

Figure 7:
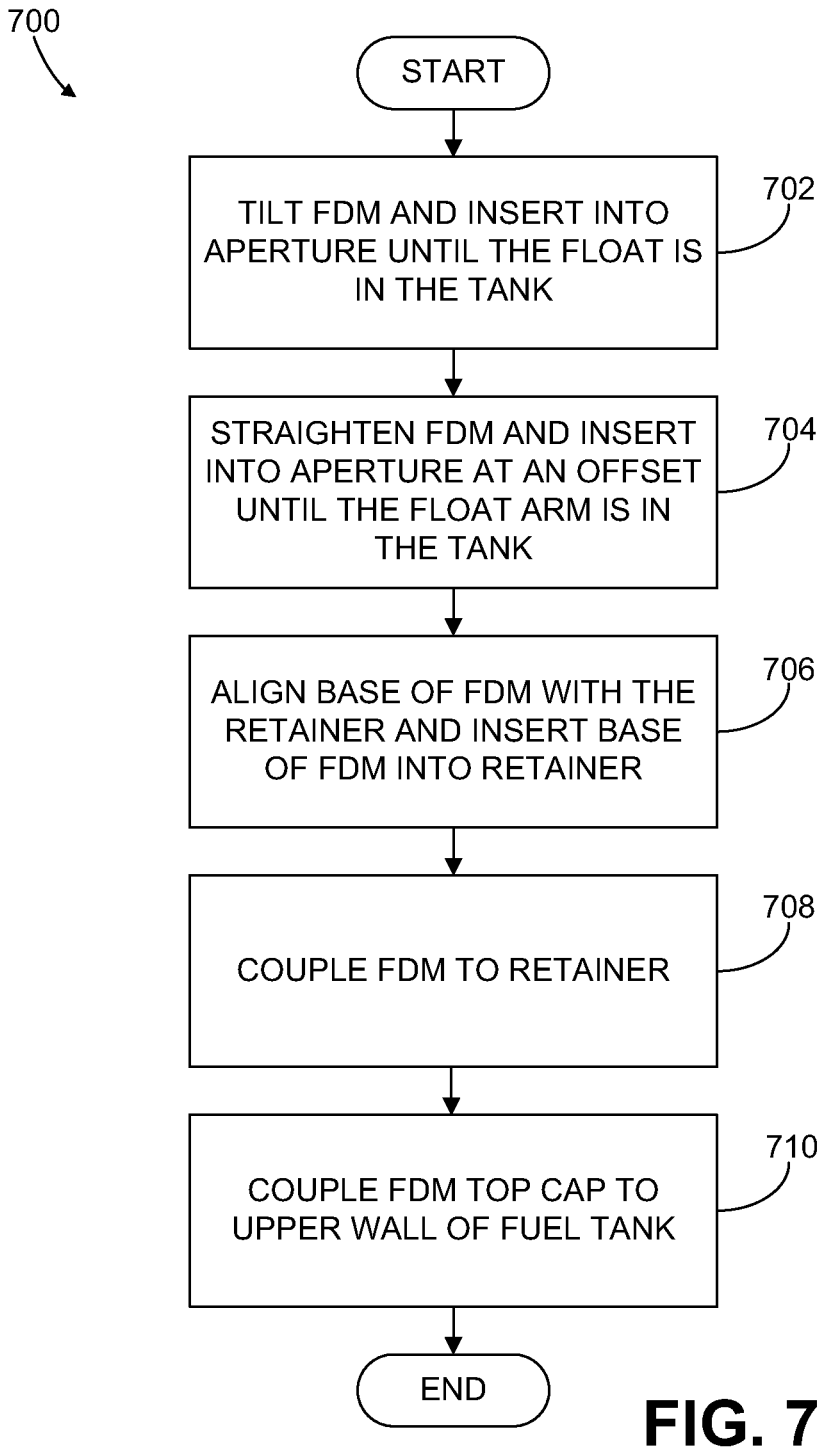
FIG. 7 shows an example method for installing a supportive fuel delivery module in a fuel tank.
Figure 8:
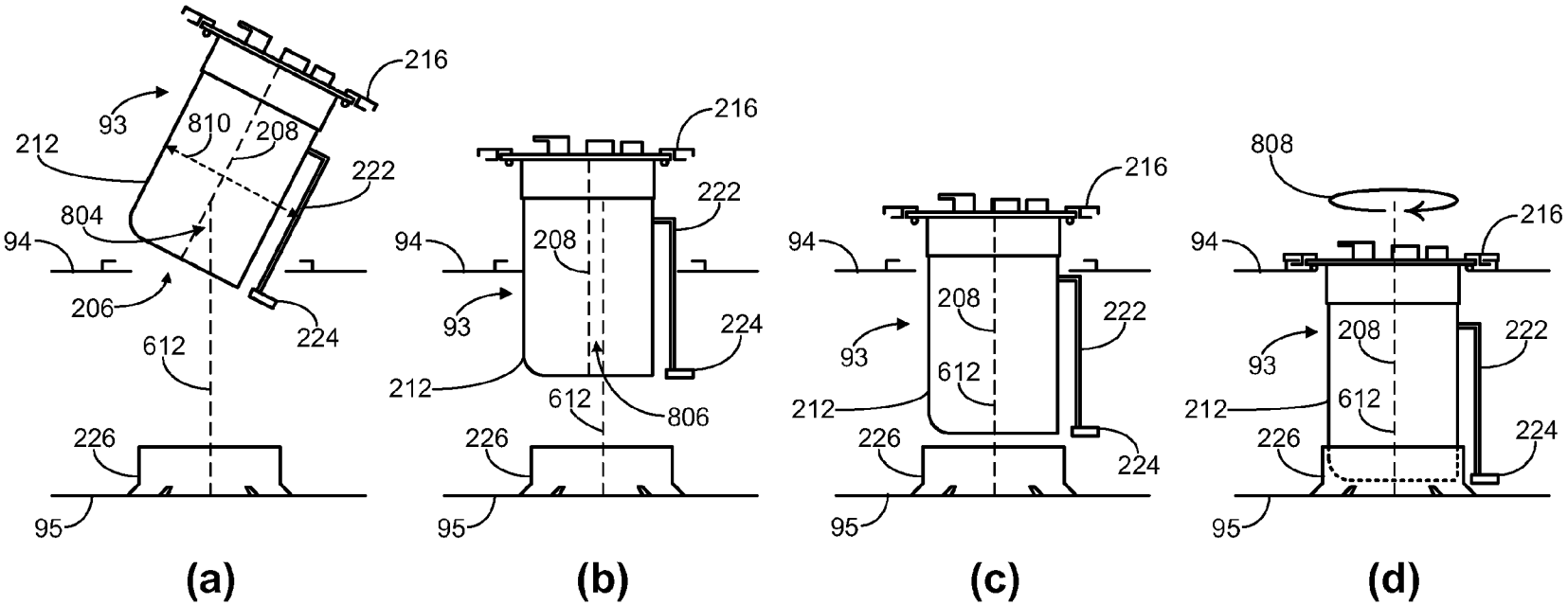
FIG. 8 illustrates an example method for installing a supportive fuel delivery module in a fuel tank.
Figure 9:
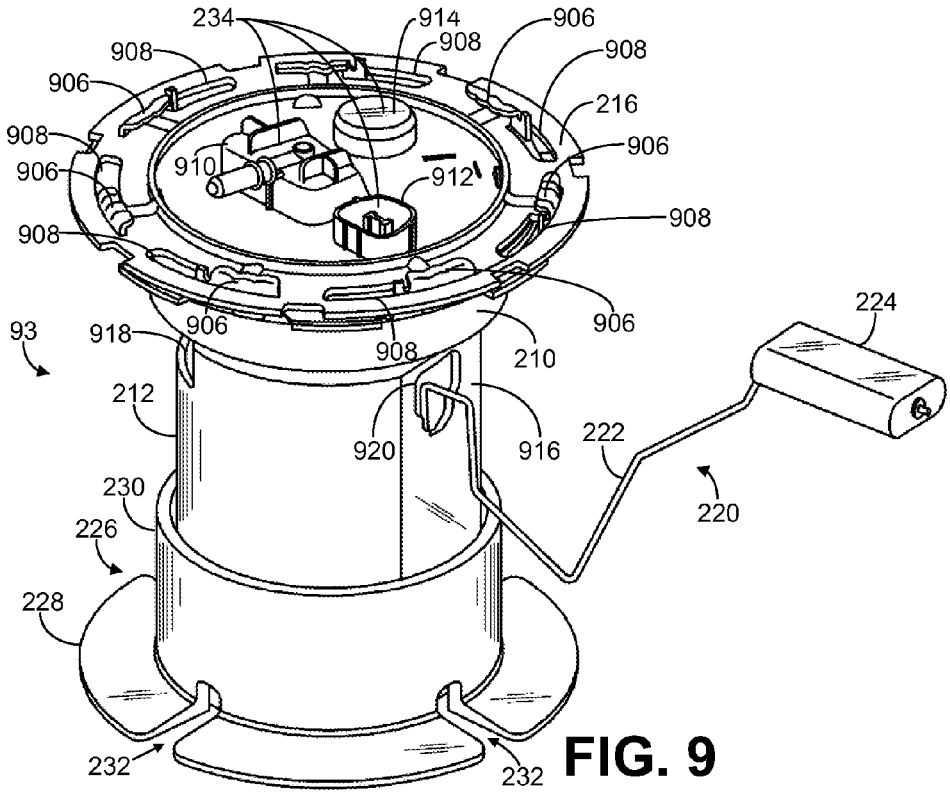
FIGS. 9-12 show various views of an example supportive fuel delivery module.
Figure 10:
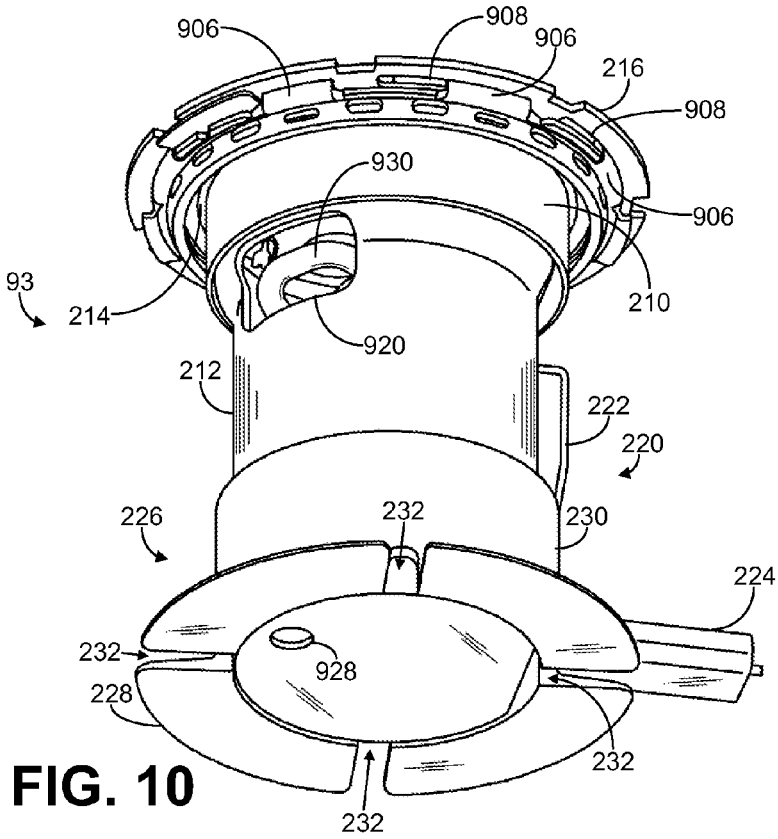

The structurally supportive FDM may be installed and coupled to regions of upper and lower walls of a fuel tank in a post fuel tank production process, e.g., as shown in FIGS. 7 and 8. In this way, the structurally supportive FDM may reduce deflections in the outer walls. Additionally, in some examples, a structurally supportive FDM installed in a fuel tank may reduce sloshing of fuel within the fuel tank, e.g., by adsorbing at least a portion of sloshing energy.

Turning now to FIG. 1, a schematic diagram of one cylinder of multi-cylinder engine 10, which may be included in a propulsion system of an automobile, is shown. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some examples, combustion chamber 30 may include two or more intake valves and/or two or more exhaust valves. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP from a throttle position sensor 58. Intake passage 42 may include a mass air flow sensor 120 and a manifold air pressure sensor 122 for providing respective signals MAF and MAP to controller 12.

A fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. In some examples, combustion chamber 30 may alternatively or additionally include a fuel injector arranged in intake passage 44 in a configuration that provides what is known as port injection of fuel into the intake port upstream of combustion chamber 30.

Fuel may be delivered to fuel injector 66 by a fuel system including a fuel tank 91, a fuel delivery module 93, a fuel line 90, and a fuel rail (not shown). The fuel delivery module 93 may be an integrated system that combines various fuel system components into a single unit positioned in the fuel tank. For example, a fuel delivery module may include a fuel pump, a reservoir or cup, and a fuel sender assembly. The fuel pump may be situated inside the reservoir and may supply fuel to the engine. The fuel delivery module 93 may be configured to support at least a portion of an upper wall 94 and a lower wall 95 of fuel tank 91. An example fuel tank including an internally positioned supportive fuel delivery module is described in more detail below.

Combustion chamber 30 or one or more other combustion chambers of engine 10 may be operated in a compression ignition mode, with or without an ignition spark. Distributorless ignition system 88 provides an ignition spark to combustion chamber 30 via spark plug 92 in response to controller 12.

Though FIG. 1 shows only one cylinder of a multi-cylinder engine, each cylinder may similarly include its own set of intake/exhaust valves, fuel injector, spark plug, etc. Additionally, though FIG. 1 shows a normally aspirated engine, engine 10 may be turbocharged in some examples.

An exhaust gas sensor 126 is shown coupled to exhaust passage 48. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor.

An emission control device 70 is coupled to the exhaust passage. Emission control device 70 can include multiple catalyst bricks, in one example. In another examples, multiple emission control devices, each with multiple bricks, can be used. In some examples, emission control device 70 may be a three-way type catalyst. In other examples, example emission control device 70 may include one or a plurality of a diesel oxidation catalyst (DOC), selective catalytic reduction catalyst (SCR), and a diesel particulate filter (DPF). After passing through emission control device 70, exhaust gas is directed to a tailpipe 77.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In some examples, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. With regards to a full series type hybrid propulsion system, the engine may be operated to generate a form of energy suitable for use by the one or more motors. For example, with a full series type hybrid electric vehicle (HEV), the engine may generate electricity via a motor/generator that may be used to power an electric motor for propelling the vehicle. As another example, an engine may be operated to provide pump work to a hydraulic or pneumatic system that may be used to power a hydraulic or pneumatic motor for propelling the vehicle. As yet another example, an engine may be operated to provide kinetic energy to a flywheel or similar device for later application at the drive wheels.

With regards to a parallel type hybrid propulsion system, the engine and one or more motors may be operated independently of each other. As one example, an engine may be operated to provide torque to the drive wheels, while a motor (e.g. electric, hydraulic, etc.) may be selectively operated to add or remove torque delivered to the wheels. As another example, the engine may be operated without the motor or the motor may be operated without the engine.

Further, with either series or parallel type propulsion systems, or combinations thereof, an energy storage device may be included to enable energy generated by the engine and/or motor to be stored for later use by the motor. For example, a regenerative braking operation may be performed, where a motor/generator is used to convert kinetic energy at the drive wheels to a form of energy suitable for storage at the energy storage device. For example, with regards to a HEV, the motor or a separate generator may be used to convert torque at the wheels or torque produced by the engine into electrical energy that may be stored at the energy storage device. A similar approach may be applied to other types of hybrid propulsion systems including hydraulic, pneumatic, or those including flywheels.

FIGS. 2-4 show an example fuel tank 91 including a fuel delivery module 93 which supports at least a portion of an upper wall 94 of fuel tank 91 and an opposing lower wall 95 of fuel tank 91. The upper wall 94 and lower wall 95 of fuel tank 91 join at an edge or sidewall 202 of fuel tank 91. Fuel tank 91 may be configured to store and assist in delivery of fuel to an engine, e.g., engine 10. FIG. 2 shows a cut-away side-view of example fuel tank 91. A top view of example fuel tank 91 is shown in FIG. 3 and a bottom view of example fuel tank 91 is shown in FIG. 4.

In some examples, the outer walls of fuel tank 91 may be composed of one or more metal materials, e.g., steel or the like. In other examples, the outer walls of fuel tank 91 may be composed at least partially of polymer or plastic materials. For example, the outer walls of fuel tank 91 may be composed at least partially of high density polyethylene (HDPE) and may be produced by a suitable molding process, e.g., using a blow molding or a twin sheet thermoforming process. In examples where the fuel tank is composed of metal materials, e.g., steel or the like, the fuel tank may be stamped and welded. In this example, the structurally supportive fuel delivery module, described in more detail below, may be used to reduce the gage of the fuel tank walls.

In a blow molding process, for example, a mass of liquid plastic at elevated temperature may be expanded in a mold by injecting gas under pressure into the plastic mass to form the fuel tank.

In some examples, fuel tank 91 may be produced using a twin sheet thermoforming process. For example, two sheets extruded from an HDPE resin may form two separate halves of the fuel tank outer wall. During the forming process auxiliary components of the fuel system may be positioned and installed on the inside wall of the tank. The two halves of the outer walls of the tank may then be brought together while still molten to seal them into a fuel tank shell. In other examples, fuel tank 91 may be produced via a split blow molding process wherein a single molded body is cut in half so that various auxiliary components of the fuel system may be positioned and installed on the inside wall of the tank. The two halves of the outer walls of the tank may then be welded together into a fuel tank shell.

The sidewall 202 of fuel tank 91 forms a perimeter around the fuel tank. In some examples one or more corners of the fuel tank may be rounded or curved so as to reduce accumulation of fuel in corners of the fuel tank. For example, the sidewall may include regions which are at least partially rounded or curved in a direction extending from the upper wall to the lower wall of the fuel tank, e.g., as shown in FIG. 2 at 203.

Additionally, the sidewall may be at least partially curved along one or more regions of the perimeter of the fuel tank. In some examples, upper and lower surfaces of the fuel tank may have at least partially curved regions to accommodate FDM and/or to increase stiffness and/or to reduce sloshing noise and/or to accommodate fuel tank packaging limitations. For example, the fuel tank may be formed as a substantially rectangular box shape with curved corners, e.g., as shown at 302 and 402 in FIGS. 3 and 4. However, it should be understood that a variety of fuel tank shapes may be used while remaining within the scope of this disclosure.

The upper wall, lower wall and sidewall of fuel tank 91 form an enclosure or substantially hollow body 204 wherein fuel may be stored. In some examples, the hollow body may be substantially sealed to reduce evaporative fuel emissions, e.g. in hybrid electric vehicle applications.

The outer walls of the fuel tank may be subjected to pressure and vacuum changes, for example due to differences between atmospheric pressure around the tank body and the pressure of a gaseous mixture of air and fuel vapor in the fuel tank body. For example, when gas pressure in the tank body exceeds atmospheric pressure, the top of the tank body may expand away from the bottom of the tank body. When atmospheric pressure exceeds the gas pressure in the tank body, the top of the tank body may collapse toward the bottom of the tank body.

Pressure and vacuum changes experienced by a fuel tank may increase when sealed evaporation control (EVAP) systems are employed to reduce evaporative emissions and fuel leakage, e.g., in hybrid electric vehicles. The amount of deflection a region of an outer wall of the fuel tank is subjected to may depend on a variety of properties of the fuel tank. For example, the amount of deflection a region of an outer wall of the fuel tank is subjected to may depend on the shape of the fuel tank, thickness of the walls of the fuel tank, components attached to the outer walls of the fuel tank, materials used in construction of the fuel tank, etc.

For example, one or more regions of the upper and lower walls of the fuel tank may be subjected to a greater amount of deflection during pressure and vacuum changes than regions of the fuel tank adjacent to the perimeter of the fuel tank. For example, center regions of the upper and lower walls of the fuel tank positioned substantially equidistant from diametrically opposed locations along the perimeter of the fuel tank may be subjected to a greater amount of deflection during pressure and vacuum changes than regions of the outer walls of the fuel tank adjacent to the perimeter. Regions of the outer walls of the fuel tank adjacent to the perimeter may have increased rigidity due to structural support conferred by the sidewall, for example.

Deflection of fuel tank walls may lead to a degradation of the fuel tank and/or components included in or attached to the outer walls of the fuel tank. For example, such deflections in the outer walls of a fuel tank may generate false signals in various fuel and/or diagnostic sensors disposed within the fuel tank. For example, some such sensors may function by creating a vacuum pressure in the interior of the tank, e.g., during diagnostic tests. The pressure in the tank may then be monitored, e.g., to check for leaks.

In such a case, deflections in the outer walls of the fuel tank may lead to false signals, e.g., a diagnostic test may indicate a false leak reading during a diagnostic test. In order to at least partially reduce deflections in the outer walls of the fuel tank, a structurally supportive fuel delivery module may be coupled to regions of the upper and lower tank walls. In some examples, the structurally supportive fuel delivery module may be coupled to regions of the upper and lower walls which are subjected to maximal deflections. In such a case various modeling routines may be used to determine regions of the outer walls which may be subjected to a maximal amount of deflection during vacuum and pressure changes. For example, a finite element analysis may be performed on the outer walls of the fuel tank to determine regions of the outer walls which may be subjected to a maximal deflection.

FIGS. 2-4 show an example structurally supporting fuel delivery module 93 coupled to center regions of the upper and lower walls of a fuel tank 91.

In FIG. 2, the supportive fuel delivery module 93 is shown in an installed position in fuel tank 91. As described above, the fuel delivery module 93 is an integrated system that combines various fuel system components into a single unit. For example, fuel delivery module 93 may include a fuel pump, a fuel reservoir, a fuel sender assembly, and/or various other fuel system components or sensors. Example fuel delivery module components are described in more detail below.

Fuel delivery module 93 may be installed through an aperture 206 in the upper wall 94 of the fuel tank and coupled to the lower wall 95 of the fuel tank in a region of the lower wall directly opposing the aperture in the upper wall. In an installed position a central axis 208 of fuel delivery module 93 may be substantially perpendicular to the lower wall in the region of the lower wall where the fuel delivery module is coupled. In some examples, fuel delivery module 93 may also be coupled to the upper wall with one or more mechanical couplings, examples of which are described below. In some examples, fuel delivery module 93 may be coupled to the upper or lower walls by a suitable welding technique.

The supportive fuel delivery module may have a variety of shapes which are sufficiently rigid to provide structural support to the upper and lower walls of the fuel tank when coupled thereto. In some examples, the supportive fuel delivery module may be substantially cylindrically shaped around central axis 208.

In some examples, a supportive fuel delivery module may be substantially composed of polymer materials. For example, a supportive fuel delivery module may be substantially composed of a thermoplastic such as polyoxymethylene or the like. The supportive fuel delivery modules may also include various other materials, such as one or more metals, rubber, etc.

As shown in FIG. 2, fuel delivery module 93 includes an FDM top cap 210 coupled to an FDM body 212. The FDM top cap 210 may be coupled to FDM body 212 by a variety of methods. For example, FDM top cap 210 may be mechanically coupled to FDM body 212, e.g., via threads, screws, or the like. As another example, FDM top cap 210 may be coupled to FDM body 212 using a suitable adhesive. As still another example, FDM top cap 210 may be coupled to FDM body 212 by a suitable welding process. In still other examples, FDM top cap 210 may be integrally molded with FDM body 212. In some examples, the FDM top cap 210 may be configured to receive a top portion of FDM body 212 during assembly of the fuel delivery module 93.

The FDM top cap 210 may include a lip or flange 214 configured to overlap a region of the upper wall 94 adjacent to a perimeter of the aperture 206. For example, as shown in FIG. 3, aperture 206 may be substantially circular with an aperture diameter 304. Flange 214 may also be substantially circular with an outer flange diameter 306 larger than the aperture diameter 304. In this example, when the fuel delivery module 93 is installed through aperture 206, the flange overlaps the upper wall 94 in an overlap region 308. In this way, when the fuel delivery module is installed in the fuel tank, the flange 214 may assist in sealing of the aperture.

The FDM top cap 210 may include or be integrated with a locking ring 216. In some examples, the locking ring may be made of a metal, e.g., steel, or plastic. For example, the locking ring may be integrally molded to the FDM top cap. As another example, the locking ring may be mechanically coupled to the FDM top cap, e.g., using various components such as bolts, screws, and the like.

The locking ring may be configured to couple the FDM top cap to the upper wall of the fuel tank. For example, the locking ring may be configured to clamp down the FDM flange 214 to the upper wall of the fuel tank. Thus, one or more components may be included on the upper wall of the fuel tank adjacent to the aperture and configured to couple with corresponding elements of the locking ring. For example, as shown in FIG. 3, the locking ring may have an outer diameter 310 greater than the outer diameter 306 of flange 214. In this way at least a portion of the locking ring may overlap with the upper wall 94 of the fuel tank so that it may be coupled thereto. The locking ring may reduce or prevent rotation of the fuel delivery module and rigidly couple the fuel delivery module to the upper wall of the fuel tank when locked in place. An example locking ring is described in more detail below.

In some examples, a sealing member 218, e.g., an o-ring or the like, may be disposed in an overlap region, e.g. region 308, between the flange 214 of the FDM top cap and the upper wall of the fuel tank to assist in sealing of aperture 206 when the fuel delivery module is in an installed position with the locking ring in place. The FDM top cap and locking ring may be installed in an orientation to create a sufficient amount of pressure on the sealing member to hermetically seal the gap between the flange 214 and the upper wall 94.

The FDM top cap may include a plurality of fuel system components 234 coupled thereto. Examples of such components are described in detail below.

As described above, the FDM top cap 210 may be coupled to the FDM body 212. The FDM body defines an interior cavity of the fuel delivery module. For example, an interior cavity 502 in an FDM body 212 is shown in FIG. 5. The FDM body may be substantially hollow so that various fuel system components may be included therein. Further, the FDM body may be substantially rigid to provide structural support to the upper and lower walls of the fuel tank when coupled thereto.

In some examples, the FDM body 212 may be composed substantially of polymer materials. For example, FDM body 212 may be substantially composed of a thermoplastic such as polyoxymethylene or the like. In some examples, FDM body 212 may include one or more support elements, such as rods, struts, ribs, molded features, or the like to increase a rigidity of the fuel delivery module. The support elements may, in some examples, be integrally molded within a portion of the body, or in other examples, may substantially comprise the body.

In some examples, FDM body 212 may be substantially cylindrically shaped. The FDM body 212 may include a variety of apertures, wall elements, or features for mounting and/or interfacing with various fuel system components. For example, FDM body 212 may include a flat region along a side of the FDM body in a direction parallel to central axis 208. For example, a flat region on the FDM body may be used to mount a fuel sender to a fuel delivery module, for example fuel sender 220. An example flat region and various apertures on an FDM body are described in more detail below.

In FIG. 2, a fuel sender 220 is shown attached to fuel delivery module 93. Fuel sender 220 may be configured to sense a fuel level in the fuel tank. The fuel sender may include a pivotal fuel sender arm 222 and a float device 224 coupled to arm 222. For example, as a fuel level in the fuel tank increases, the float device 224 may rise with increasing fuel level causing the fuel sender arm 222 to pivot. The pivotal float arm may be coupled to various components, e.g., a solenoid, in the interior of the FDM body through an aperture in a flat wall of the FDM body. An example fuel sender is described in more detail below.

The FDM body 212 may include a reservoir or cup configured to retain a quantity of fuel for delivery to an engine. The reservoir may be configured to maintain a substantially constant source of fuel for a fuel pump within the fuel delivery system in the fuel delivery module. Thus, the reservoir may be continuously replenished with fuel by routing a portion of pressurized fuel to a jet pump, e.g., a jet pump mounted within the reservoir, to entrain fuel from the fuel tank to the reservoir or by routing return fuel to the reservoir, or a combination of the two. In some examples, fuel may be pressurized in the reservoir (e.g. to reduce vaporization of the fuel therein). An example reservoir is described in more detail below herein.

A base portion of FDM body 212 may be coupled to the lower wall 95 of the fuel tank by a variety of methods. In some examples, the lower wall 95 of fuel tank 91 may include an FDM retainer 226 coupled thereto and configured to couple with a base portion of the FDM body. For example, FDM retainer 226 may be configured to lockably receive a base portion of the FDM body.

In some examples, the fuel sender may extend a distance beyond a wall of the retainer. For example, a region 223 of the fuel sender 220 which overlaps the retainer when the fuel delivery module is installed therein, e.g., a region of the fuel sender adjacent to and including the float device 224, may be positioned a threshold distance 225 from the FDM body, where the threshold distance 225 is sufficiently large so that the range of motion of the fuel sender is not reduced by the FDM retainer when the fuel delivery module is installed therein. In this example, the threshold distance may depend on the range of motion, e.g., degrees of freedom, of the fuel sender 220 within the fuel tank.

The FDM retainer 226 may be composed of a variety of materials. For example, retainer 226 may be substantially composed of a polymer material such as high-density polyethylene (HDPE) or the like. In some examples, retainer 226 may include various components to increase a rigidity of the retainer and assist in coupling of the retainer to the lower wall of the fuel tank. For example, retainer 226 may include metal support structure, bolts, etc.

An FDM retainer may be formed in a variety of shapes and may be coupled to a region of lower wall 95 of the fuel tank by a variety of methods. For example, FDM retainer 226 may be integrally molded with the lower wall 95 of the fuel tank, e.g., by a suitable molding process. As another example, retainer 226 may be welded to the lower wall of the fuel tank by a suitable welding process. In still another example, retainer 226 may include bolts or other components to assist in its attachment to the lower wall of the fuel tank.

As shown in FIGS. 2 and 6, an FDM retainer 226 may comprise a weld pad 228 and a main cylinder 230. The weld pad may be coupled to the lower wall 95 of the fuel tank in a region of the lower wall directly opposing aperture 206 in upper wall 94. Weld pad 228 may be integrally molded with, welded to, and/or mechanically coupled to the lower wall of the fuel tank.

The type of coupling employed to attach the retainer to the lower wall of the fuel tank may depend on one or more physical properties of the fuel tank. For example, if welded to the lower wall of the fuel tank, fillet size and thickness of the weld may be adjusted based on a variety of properties of the fuel tank. For example, fillet size and thickness of the weld may be adjusted based the geometry and outer wall thickness of the fuel tank. For example, the fillet size may be increased to reduce stress experienced by retainer when a fuel delivery module is installed therein.

A plurality of openings 232 may be included at a base portion of the retainer, e.g., in the weld pad of the retainer, for receiving fuel from the fuel tank. In some examples, the FDM retainer may be comprised of a plurality of separate standing pieces to allow fuel to flow into the fuel delivery module. The fuel flowing into the fuel delivery module via openings 232 may be pumped into a reservoir for subsequent delivery to an engine, for example.

FDM retainer 226 may couple a base portion of the FDM body to the lower wall by a variety of methods. In some examples, FDM retainer 226 may be configured to lockably receive a base portion of the FDM body. For example, the main cylinder 230 of the retainer may include an aperture sized for receiving a base portion of the FDM. For example, FIG. 6 shows a retainer aperture 602 in an FDM retainer 226 sized to receive a base portion 516 of an FDM body 212.

In some examples, various locking features may be included on a base portion of the FDM body with corresponding locking features included on the interior of the retainer. In this way, the fuel delivery module may be lockably inserted into the retainer coupled to the lower wall of the fuel tank.

For example, a base portion of the FDM body may include various external features configured to mate with corresponding internal features included in the interior of the retainer. For example, such external features on a base portion of the FDM body may includes threads, tabs, slots or the like configured to mate with corresponding internal features on the internal surface on the retainer. In this way the FDM body may be coupled within the retainer and fixedly held in place.

FIG. 5 shows example external features 504 included on a base portion 516 of FDM body 212. In FIG. 6, corresponding internal features 604 configured to lockably receive external features 504 are shown included on an interior surface of FDM retainer 226 within retainer aperture 602.

Specifically, FIG. 5 shows a plurality of external threaded features 504 on a base portion 516 of the FDM body 212. Each external threaded feature extends at least partially around an outer circumference of the cylindrical FDM body 212. In this example, a distance from each external thread to the bottom 506 of the FDM body may decrease in a direction around the central axis 208 of the cylindrical FDM body. For example, a distance 510 from threaded feature 512 to bottom 506 decreases in a clockwise direction 508 around the central axis 208.

In some examples, various locking components may be included on each external threaded feature to assist in fixedly coupling the FDM body within the FDM retainer. Examples of such locking components may include tabs, slots, or the like positioned on or adjacent to the external threaded features. For example, external thread 512 includes a locking component 514. Locking component 514 is a tab on external threaded feature 512 configured to mate with a corresponding slot, e.g., slot 616, in the FDM retainer.

The external threaded features 504 on the base portion of FDM body 212 are configured to interlock with internal features 604 included on an interior surface of FDM retainer 226 shown in FIG. 6.

In FIG. 6 each internal threaded feature is configured to mate with a corresponding external threaded feature on FDM body 212. For example, internal threaded feature 606 may be configured to lockably receive external threaded feature 512 and may be held in place when tab 514 is inserted into slot 616.

As described above with reference to external threaded features 504 on the FDM body, a distance from each internal thread to the bottom 608 of FDM retainer 226 may decrease in a direction around a central axis 612 of the cylindrical FDM retainer 226. For example, a distance 614 from internal threaded feature 606 to retainer bottom 608 may decrease in a clockwise direction 610 around the central axis 612 of the retainer. The change in distance from each internal thread to the bottom of the FDM retainer may directly correspond to the change in distance from each external thread on the FDM body.

In some examples, the interior surface of the FDM retainer may include various features configured to guide the external threaded features on the base of the FDM body into the corresponding internal threaded features within the FDM retainer. For example, the interior surface of the FDM retainer may include one or more rails, e.g., rail 607, or similar features configured to guide the threads on the FDM body into the grooves or internal threaded features in the FDM retainer.

In this way, when a base portion of the FDM body is inserted into the FDM retainer, the external locking features on a bottom portion of the FDM body may be guided into and locked within the corresponding internal locking features in the interior of the retainer. For example, the FDM body 212 may be inserted into the retainer, twisted, and locked into place. For example, a 45 degree, or similar twist may be employed to fixedly lock the FDM body into the retainer.

FIG. 7 shows an example method 700 for installing a structurally supportive fuel delivery module in a fuel tank. Method 700 will be described concurrently with FIG. 8 which illustrates an example installation process.

At 702, method 700 includes tilting and inserting the fuel delivery module into an aperture in the upper wall of the fuel tank until a float on a fuel sender device coupled to the fuel delivery module is in the tank. For example, as illustrated in FIG. 8*a*, fuel delivery module 93 may be tilted and inserted into aperture 206 so that float 224 is inserted into aperture 206 before the FDM body is inserted into the aperture. At 702, the fuel delivery module may be tilted toward the side of the fuel delivery module where the fuel sender is coupled. Thus the central axis 208 of fuel delivery module 93 may form an angle 804 with a central axis 612 of the retainer so that float 224 is inserted into aperture 206 before the FDM body 212 is inserted into the aperture. A diameter of aperture 206 may be larger than a distance 810 from a side of FDM body 212 opposing float arm 222 to the float arm 222 so that the fuel delivery module fits into the aperture.

Once the float 224 is inserted into the fuel tank, method 700 proceeds to 704. As illustrated in FIG. 8*b*, at 704 method 700 includes straightening fuel delivery module 93 and continuing to insert fuel delivery module 93 into aperture 206 at an offset 806. Offset 806 is a non-zero distance from the central axis 208 of the fuel delivery module to the central axis 612 of the retainer. In this way, the FDM body 212 and float arm 222 may be inserted into the fuel tank since the float arm 222 extends a non-zero distance from the FDM body. Once the float arm is in the fuel tank, method 700 proceeds to 706.

At 706 method 700 includes aligning the central axis 208 of the fuel delivery module with the central axis 612 of the retainer and inserting a base portion of the FDM body into retainer 226, as illustrated in FIG. 8*c*. Once a base portion of the fuel delivery module is inserted into retainer 226, method 700 proceeds to 708.

At 708, method 700 includes coupling the base portion of the FDM body within the FDM retainer. For example, as described above, the base portion of FDM body 212 may include external features configured to mate with corresponding internal features in the retainer. Thus the fuel delivery module may be guided, twisted, and/or screwed, e.g., a 45 degree clockwise twist, into a locked position within the retainer, as illustrated in FIG. 8*d* at 808. In some examples, a base portion of the FDM body may include a plurality of external threads and may be twisted or screwed into the retainer with a plurality of corresponding internal threads until a top flange of the fuel delivery module, e.g. top flange 214, reaches a predetermined position relative to the upper wall 94 of the fuel tank.

At 710, method 700 includes coupling the top cap of the fuel delivery module, e.g., top cap 210, with the upper wall 94 of the fuel tank. For example, a flange of the top cap, e.g., flange 214, may be compressed to the upper wall with a locking ring in order to at least partially seal the aperture, as described above. The locking ring may couple with various components on the upper wall of the fuel tank in order to assist in sealing the aperture and fixedly coupling the top cap of the fuel delivery module to the upper wall of the fuel tank. For example, one or more features on a locking ring coupled to the top cap may be engaged with one or more corresponding features on the upper wall to substantially seal the aperture.

In some examples, the top cap may be coupled to the upper wall of the fuel tank substantially concurrently with the coupling of the base of the FDM body within the retainer. For example, twisting the FDM body into a locked position in the retainer may correspond with a twist of the locking ring which couples the top cap to the upper wall.

In this way the structurally supportive fuel delivery module may be fixedly attached to the upper and lower walls of the fuel tank leading to a reduction in deflections in the outer walls of the fuel tank during pressure and vacuum changes.

Turning now to FIGS. 9-12, various example components of an example supportive fuel delivery module 93 are shown and described in detail. The example supportive fuel delivery module 93 is shown approximately to scale in FIGS. 9-12.

Figure 11:
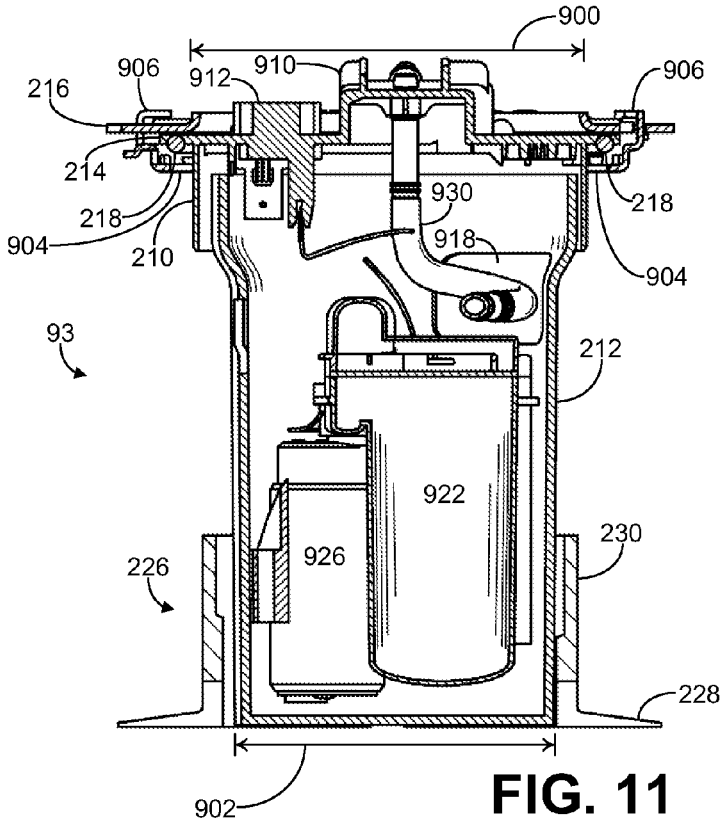

The example fuel delivery module 93 shown in FIGS. 9-12 includes an FDM top cap 210 coupled to an FDM body 212. In this example, as shown in FIG. 11, a diameter 900 of FDM top cap 210 is larger than a diameter 902 of FDM body 212. In some examples, the diameter 900 of FDM top cap 210 beneath the flange of the top cap is substantially the same as the diameter of an aperture in an upper wall of a fuel tank, e.g., the diameter 900 of FDM top cap 210 may be substantially equal to the diameter 304 of aperture 206 shown in FIG. 3.

Figure 12:
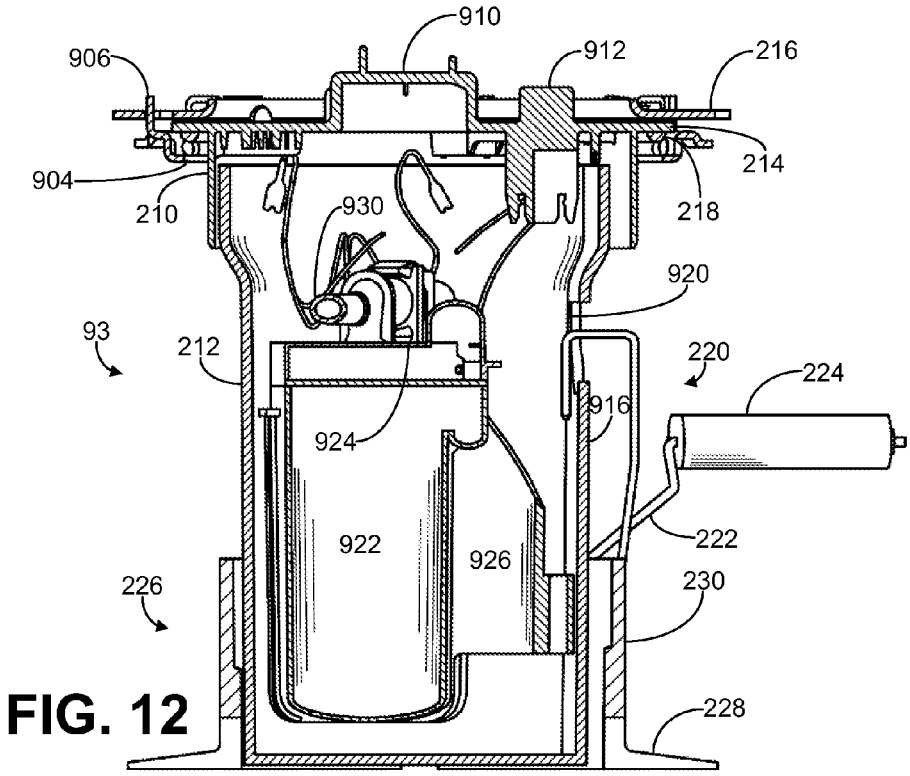

The FDM top cap 210 includes a flange 214 which is configured to overlap a region of an upper wall of a fuel tank adjacent to a perimeter of an aperture in the upper wall of said fuel tank, e.g. aperture 206 shown in FIG. 3. FIGS. 11 and 12 show a cutaway view of an example region 904 of an upper wall of a fuel tank adjacent to a perimeter of an aperture in the upper wall of said fuel tank. For example, region 904 shown in FIGS. 11 and 12 may correspond to region 308 shown in FIG. 3.

As shown in FIGS. 9-12, a plurality of locking components 906 may be included on the upper wall of the fuel tank adjacent to an aperture in the upper wall of the fuel tank. The plurality of locking components 906 on the upper wall of the fuel tank are configured to mate with corresponding components on a locking ring 216 coupled to FDM top cap 210.

For example, locking ring 216 may include a plurality of apertures 908 configured to receive the plurality of locking components 906 coupled to the upper wall of the fuel tank adjacent to the aperture. For example, after the fuel delivery module is inserted into the fuel tank, e.g., using method 700 described above, each locking component of the plurality of locking components 906 coupled to the upper wall of the fuel tank may be inserted into a corresponding aperture in the plurality of apertures 908 included in locking ring 216. In some examples, the locking ring may be twisted in a first direction, e.g., a clockwise direction, to fixedly couple the FDM top cap to the upper wall of the fuel tank. In some examples, the locking ring may be twisted in a second direction, e.g., a counter-clockwise direction, to unlock or decouple the FDM top cap from the upper wall of the fuel tank, e.g., to remove the fuel delivery module from the fuel tank for servicing.

A sealing member 218, e.g., an o-ring or the like, is shown disposed in an overlap region between the flange 214 of the FDM top cap and region 904 of the upper wall of a fuel tank adjacent to a perimeter of an aperture in the upper wall of said fuel tank. The sealing member may extend around the entire circumference of the FDM top cap beneath flange 214 and may be composed of a compressible material, e.g., silicone, or the like.

When the locking ring 216 is installed, e.g., as described above, the locking ring may compress sealing member 218 between flange 214 and the upper wall of the fuel tank. The amount of compression conferred by the locking ring onto the sealing member may be sufficient to substantially seal the aperture in the upper wall of the fuel tank when the fuel delivery module is in an installed configuration.

The FDM top cap may include a plurality of fuel system components 234 coupled thereto. Examples of such components include a fuel delivery component 910, a power component 912 configured to supply power to various components included in the fuel delivery module, a filter device 914 (e.g., an integrated lifetime filter), among others.

The FDM body 212 includes a variety of apertures, wall elements, or features for mounting and/or interfacing with various fuel system components. For example, FDM body 212 may include a flat region 916 to mount a fuel sender 220 to the fuel delivery module and an aperture 918 configured to provide access to various internal components in the fuel delivery module, e.g., for servicing.

As described above, the fuel sender 220 includes a pivotal fuel sender arm 222 and a float device 224 coupled to arm 222. In some examples, float device 224 may be configured to rotate about the float arm 222. The pivotal float arm may be coupled to various components, e.g., a solenoid, in the interior of the FDM body through an aperture 920 in a flat wall 916 on the FDM body, which may send signal indicating a fuel level to a controller, e.g., controller 12, via power component 912.

As described above, the substantially hollow cylindrically-shaped FDM body 212 shown in FIGS. 9-12 may be may be sufficiently rigid to provide structural support to the upper and lower walls of the fuel tank when coupled thereto and substantially hollow so that various fuel system components may be included therein.

As described above, the FDM body 212 may include a reservoir 922 configured to retain a quantity of fuel for delivery to an engine. In some examples, one or more components of the fuel pump may be included within reservoir 922. Said fuel pump is configured to deliver fuel from the reservoir to an engine via a fuel conduit 930 and fuel delivery component 910. Additionally, a secondary fuel pump 926, e.g., a jet pump, may be configured to fill the reservoir with fuel from the fuel tank. Thus, the reservoir may be continuously replenished with fuel by routing a portion of pressurized fuel to a jet pump to entrain fuel from the fuel tank to the reservoir or by routing return fuel to the reservoir, or a combination of the two.

Fuel from the fuel tank may be received through an aperture 928 in the bottom of the FDM body 212 via a plurality of apertures 232 in the weld pad 238 of the retainer 226. The fuel flowing into the fuel delivery module via openings 232 and 928 may be pumped into a reservoir by secondary pump 926 for subsequent delivery to an engine, for example.

In some examples, fuel delivery module 93 may include various filters to reduce contaminates in the fuel.

It will be appreciated that the configurations and routines disclosed herein are exemplary in nature, and that these specific embodiments are not to be considered in a limiting sense, because numerous variations are possible.

The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

a fuel tank including an upper wall and a lower wall;

a support member, the support member coupled to the upper and lower walls and including a plurality of fuel delivery system components; and a retainer coupled to the lower wall, and wherein a base portion of the support member includes a plurality of external threaded features and the retainer includes a plurality of corresponding internal threaded features, each external threaded feature mating with a corresponding internal threaded feature to couple the support member to the lower wall.

2. The system of claim 1, wherein the support member resists a compression of the upper wall towards the lower wall, and wherein the support member resists an expansion of the upper wall away from the lower wall.

3. The system of claim 1, wherein the upper wall includes an aperture sized to receive the support member, the support member including a substantially hollow rigid body with a rigid cap coupled thereto, the hollow body including the plurality of fuel delivery system components, the rigid cap including a flange overlapping a region of the upper wall adjacent to the aperture, a sealing member positioned between the flange and the region, the flange including a locking ring coupled thereto, the locking ring mating with a plurality of elements on the upper wall and compressing the sealing member to seal the aperture.

4. The system of claim 1, wherein the support member is a fuel delivery module.

5. The system of claim 1, wherein the plurality of fuel delivery system components includes a fuel delivery module, the fuel delivery module including a substantially cylindrical hollow body enclosing a fuel pump.

6. The system of claim 1, wherein the support member is coupled to the lower wall via the retainer, the retainer coupled to the lower wall, the retainer lockably receiving a portion of a body via a twist-lock connection.

7. The system of claim 6, wherein the retainer includes a plurality of apertures, the plurality of apertures receiving fuel from the fuel tank for delivery to an engine.

8. The system of claim 1, wherein the upper wall includes an aperture sized to receive the support member.

9. A system comprising:

a fuel tank including an upper wall and a lower wall, the upper wall including an aperture sized to receive a structurally supportive fuel delivery module, the structurally supportive fuel delivery module including a top cap and body, the top cap coupled to the upper wall; and a retainer coupled to the lower wall, the retainer lockably receiving a portion of the body.

10. The system of claim 9, wherein the structurally supportive fuel delivery module resists a compression of the upper wall towards the lower wall, and wherein the structurally supportive fuel delivery module resists an expansion of the upper wall away from the lower wall.

11. The system of claim 9, wherein the structurally supportive fuel delivery module includes a substantially cylindrical hollow rigid body enclosing a fuel pump.

12. The system of claim 9, wherein the retainer includes a plurality of apertures, the plurality of apertures receiving fuel from the fuel tank for delivery to an engine.

13. The system of claim 9, wherein the top cap includes a flange overlapping a region of the upper wall adjacent to the aperture, a sealing member positioned between the flange and the region, the flange including a locking ring coupled thereto, the locking ring mating with a plurality of elements on the upper wall and compressing the sealing member to seal the aperture.

14. The system of claim 9, wherein the top cap is coupled to the upper wall via a twist-lock connection.

15. The system of claim 9, wherein a base portion of the body includes a plurality of external threaded features and the retainer includes a plurality of corresponding internal threaded features, each external threaded feature mating with a corresponding internal threaded feature.

16. The system of claim 9, wherein the structurally supportive fuel delivery module includes a fuel sender, the fuel sender comprising a fuel sender arm with a float coupled thereto, the fuel sender extending a distance beyond a wall of the retainer.

17. A method for installing a structurally supportive fuel delivery module in a fuel tank, the fuel delivery module including a top cap and a body, the fuel tank including an upper wall and a lower wall, the method comprising:

inserting the body into an aperture in the upper wall, the aperture sized to receive the body;

inserting a base portion of the body into a retainer coupled to the lower wall, the retainer configured to lockably receive the base portion; and coupling the top cap to the upper wall.

18. The method of claim 17, wherein the structurally supportive fuel delivery module includes a substantially cylindrical hollow body enclosing a fuel pump, the structurally supportive fuel delivery module includes a fuel sender, the fuel sender comprising a fuel sender arm with a float coupled thereto, the fuel sender extending a distance beyond a wall of the retainer, and inserting the body into an aperture in the upper wall includes tilting the body to insert the float in the fuel tank before the body, straightening the body following insertion of the float in the fuel tank, and inserting the body into the aperture at an offset until the fuel sender arm is in the tank.

19. The method of claim 17, wherein coupling the top cap to the upper wall includes engaging one or more features on a locking ring coupled to the top cap with one or more corresponding features on the upper wall and sealing the aperture, and wherein the base portion of the body includes a plurality of external threaded features and the retainer includes a plurality of corresponding internal threaded features, each external threaded feature configured to mate with a corresponding internal threaded feature, and inserting the base portion of the body into the retainer includes engaging the external threaded features with the corresponding internal threaded features.

* * * * *